US006196853B1

(12) United States Patent
Harting et al.

(10) Patent No.: US 6,196,853 B1
(45) Date of Patent: Mar. 6, 2001

(54) ELECTRIC PLUG CONNECTOR

(75) Inventors: Dietmar Harting, Espelkamp; Günter Pape, Enger; Andreas Kohler, Minden, all of (DE)

(73) Assignee: Harting KGaA (DE)

( * ) Notice: Subject to any disclaimer, the term of this patent is extended or adjusted under 35 U.S.C. 154(b) by 0 days.

(21) Appl. No.: 09/326,259

(22) Filed: Jun. 4, 1999

(51) Int. Cl.[7] ..... H01R 9/09
(52) U.S. Cl. ..... 439/79; 439/608
(58) Field of Search ..... 439/79, 686, 607–609, 439/701, 76.1, 620, 660, 941

(56) References Cited

U.S. PATENT DOCUMENTS 5,716,237 * 2/1998 Conorich et al. ..... 439/660
5,924,899 * 7/1999 Paagman ..... 439/701
5,961,355 * 1/2000 Morlion et al. ..... 439/686
6,010,373 * 1/2000 Donahue ..... 439/717

FOREIGN PATENT DOCUMENTS 195 33 295 C1 4/1997 (DE) .
196 34 844 A1 3/1998 (DE) .

* cited by examiner

*Primary Examiner*—Khiem Nguyen
*Assistant Examiner*—J. F. Duverne
(74) *Attorney, Agent, or Firm*—Cook, Alex, McFarron, Manzo, Cummings & Mehler, Ltd.

(57) ABSTRACT

In an electric plug connector comprising a carrier body (19) consisting of insulating material and a plurality of segments (2), inserted into the carrier body (19), with contacts (5) and terminals (4), the retention of the segments in the carrier body is to be improved. For this purpose an additional member (3) consisting of insulating material is provided which fixes the segment (2) in the carrier body (19).

9 Claims, 5 Drawing Sheets

ELECTRIC PLUG CONNECTOR

The invention relates to an electric plug connector comprising a carrier body consisting of insulating material and a plurality of segments, inserted into the carrier body, with contacts and terminals.

A complementary plug connector is plugged into such a connector, which can have the form of a spring-contact strip or blade-contact strip, to form a multipolar plug connection. The segments inserted one beside another into the carrier body of the plug connector bear contacts on the side which is introduced into the carrier body, said contacts having the form of contact springs in the case of a spring-contact strip or contact blades in the case of a blade-contact strip and serving to establish the contact with the corresponding contact blades or contact springs of the complementary plug connector. Terminals connected to the respective contacts are formed on another side of the segments, which terminals can be connected for example to circuit board leads. Here the terminals can extend at right angles to the plug-in direction of the plug connector.

The segments, with their contacts and terminals, are produced in various forms. In one method of production the contacts are extrusion-coated, although this is relatively costly. In another method the segments consist of two parts and the contacts are inserted between the two segment halves. This has the disadvantage, however, that considerably more individual parts must be processed overall. Finally, the contacts can also simply be inserted in discs, although this has a disadvantageous effect on their tightness of fit.

German OS 196 34 844 and German Patent 195 33 295 have disclosed housings into which an inner housing can be inserted. A cover or cap is used to define the inner housing in the actual housing.

The object of the invention is to provide an electric plug connector designed in accordance with segment technology wherein the segments are reliably, precisely and firmly installed in the plug connector with a simple and thus cost-effective assembly.

This object is achieved by means of an electric plug connector comprising a carrier body consisting of insulating material and a plurality of segments, inserted into the carrier body, with contacts and terminals, wherein an additional member consisting of insulating material is provided which fixes the segments in the carrier body and is provided with comb-like projections arranged between the segments. Such an additional member provides for a firm retention of the segments in the carrier body and has the advantage that it additionally serves to insulate the segments from one another and thus leads to an improvement in respect of the required creepage distances and clearances in the plug connector, these being undesirable in plug connectors.

Preferably, the terminals of the segments are connectible at right angles to the plug-in direction of the contacts so as to obtain an advantageous plug connection configuration in the case of which the terminals of the segments project at right angles to the plug-in direction of the plug connector, for example into corresponding bores of a circuit board. A plug connector can thus be plugged-in in space-saving manner in the longitudinal direction of the board.

It also proves advantageous to provide the additional member with projections for fixing the contacts of the segments inserted into the carrier body so as to facilitate their precise positioning. This can be achieved particularly easily when the contacts are offset and engage with the projections of the additional member. Reliable contacting of the segment contacts with the corresponding contacts of the complementary plug connector is then ensured.

Further improved fixing of the segments and their contacts can be achieved by means of different additional measures. Thus for example a bearing surface of the additional member can press against a first end surface of each segment facing away from the contacts and can thus press a second end surface of the segment, disposed opposite the first end surface, onto a stop of the carrier body, thereby defining the insertion depth of the segments into the carrier body. Fixing of the segments transversely to their plug-in direction is facilitated by rib-like projections of the additional member which in each case engage into a corresponding recess in the first end surface of a segment. Finally the outer segments of the plug connector can preferably be retained by means of a protrusion of the bearing surface of the additional member, which protrusion engages into a corresponding recess of the first end surface of a segment.

For an optimal fit of the additional member in the carrier body, the additional member preferably comprises sprung detents which engage into corresponding locating openings of the carrier body and thus facilitate firm locking. For this purpose, a support wall in the carrier body can also be provided with ribs, said ribs in each case comprising a cut-out into which a corresponding integral protuberance of the additional member engages.

Finally, for the rapid and simple disassembly of the plug connector into its individual parts, it has proved advantageous for the carrier body and the segments to be held together only by means of the additional member.

Further features and advantages of the invention are set forth in the following description of a preferred embodiment making reference to the drawing wherein.

Figure 1:
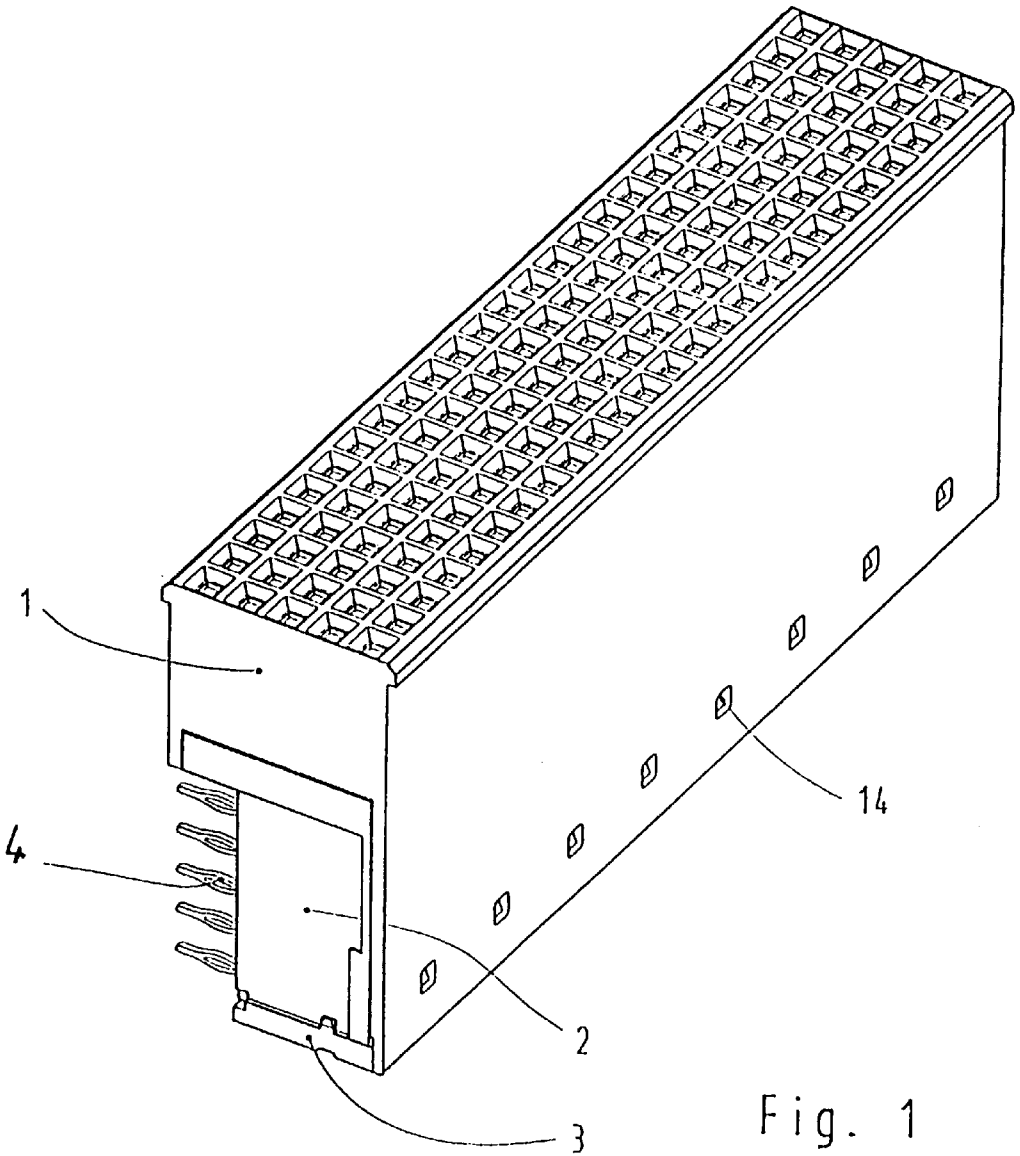
FIG. 1 is a perspective view of an electric plug connector having the form of a spring-contact strip.
Figure 3:
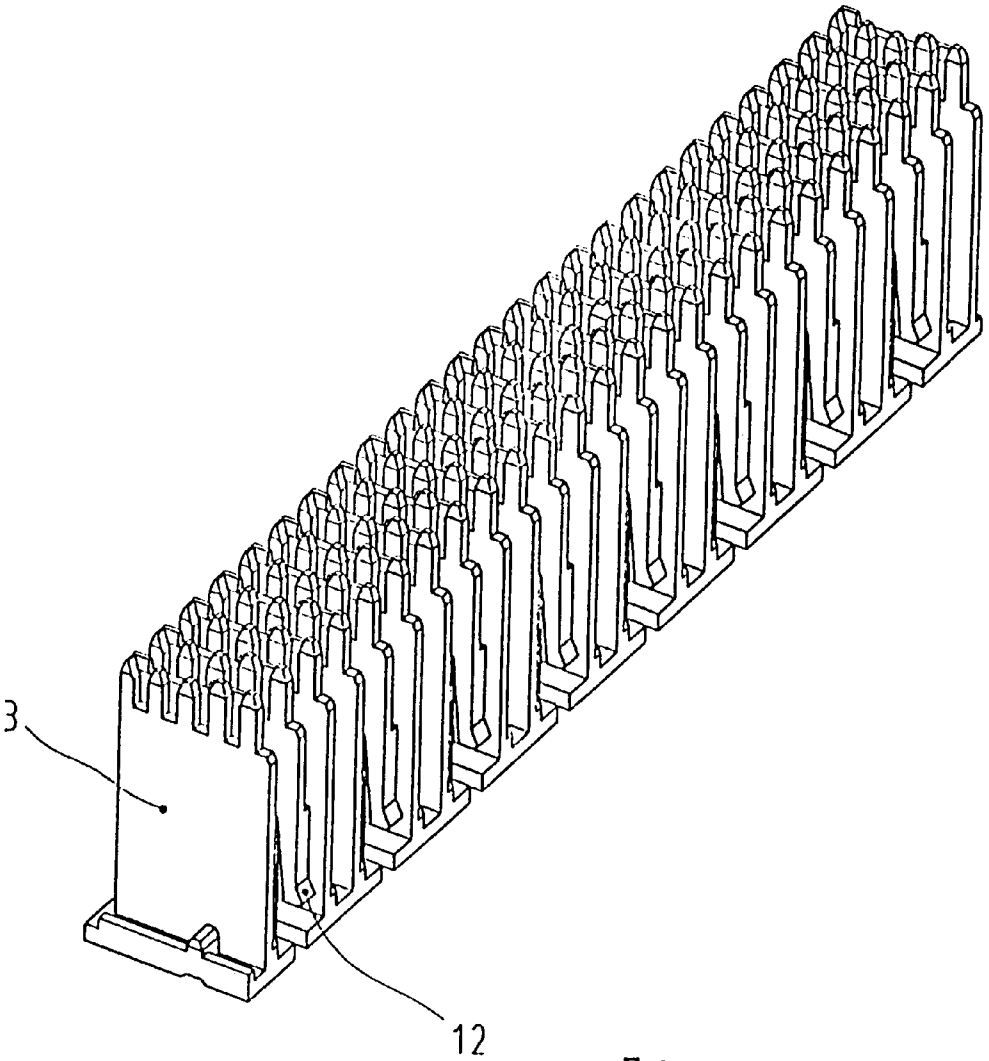
FIG. 3 is a perspective view of an additional member used in the plug connector shown in FIG. 1.
Figure 3A:
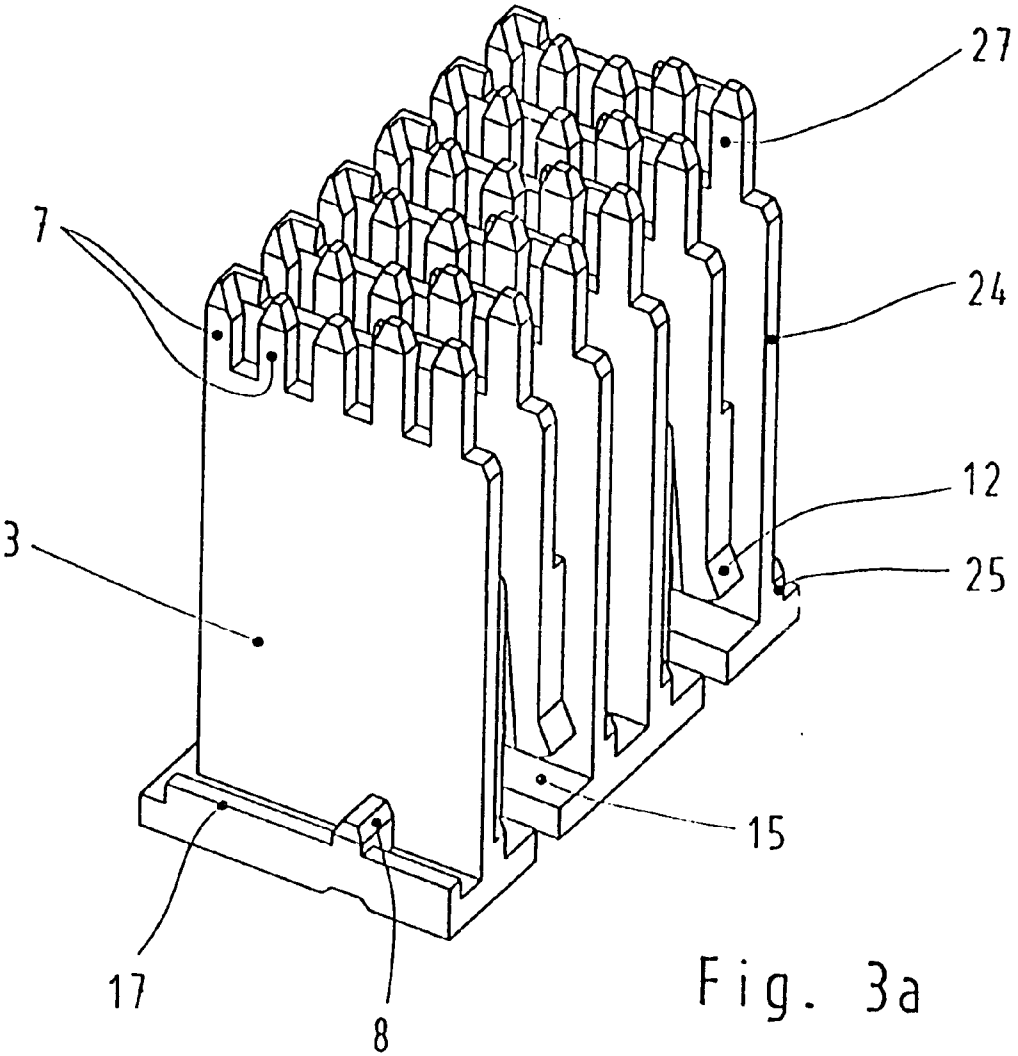
Figure 4:
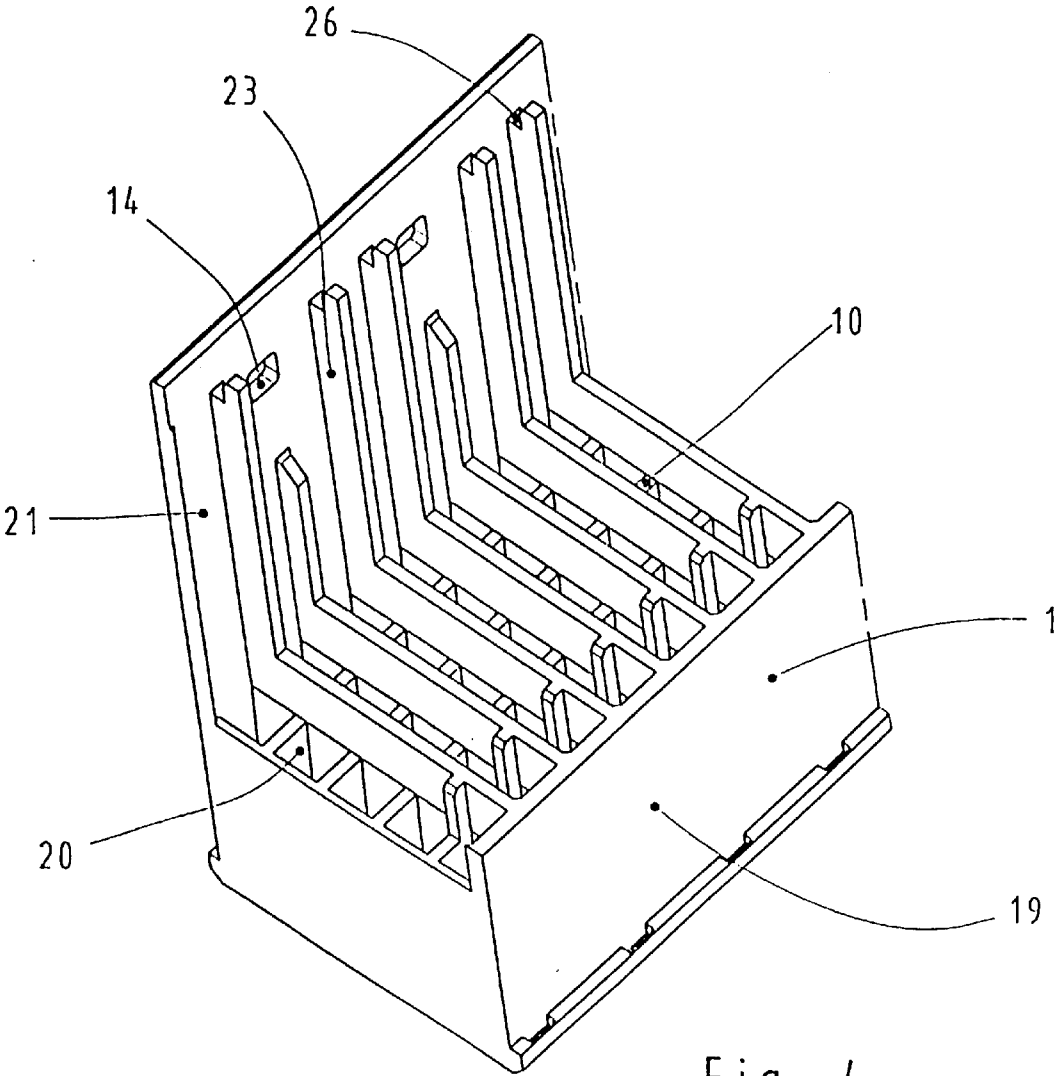

FIG. 3*a* illustrates a portion of the additional member according to FIG. 3 on an enlarged scale; and FIG. 4 is a perspective view of a portion of a carrier body used in the plug connector according to FIG. 1 on an enlarged scale.

FIG. 1 illustrates a complete plug connector 1 in the assembled state. The plug connector 1 substantially comprises a rectangular carrier body 19 consisting of plastics material and having recesses for a plurality of segments 2 inserted one beside another and provided with terminals 4 and contacts 5 (see FIG. 2) fixed in a defined position by an additional member 3. Here the additional member 3 is designed such that it does not project out of the space defined by the side walls of the carrier body 19, i.e. the overall volume of the plug connector is not enlarged by the additional member 3. The plug connector 1 shown in FIG. 1 is a multipolar spring-contact strip with contacts which have the form of contact springs and are inserted into recesses 20 of the carrier body 19. However, the invention can equally relate to a blade-contact strip with a base member comprising openings into which segments bearing contact blades are inserted, in the case of which a collar is provided surrounding the plug-in region of the contact elements.

Figure 2:
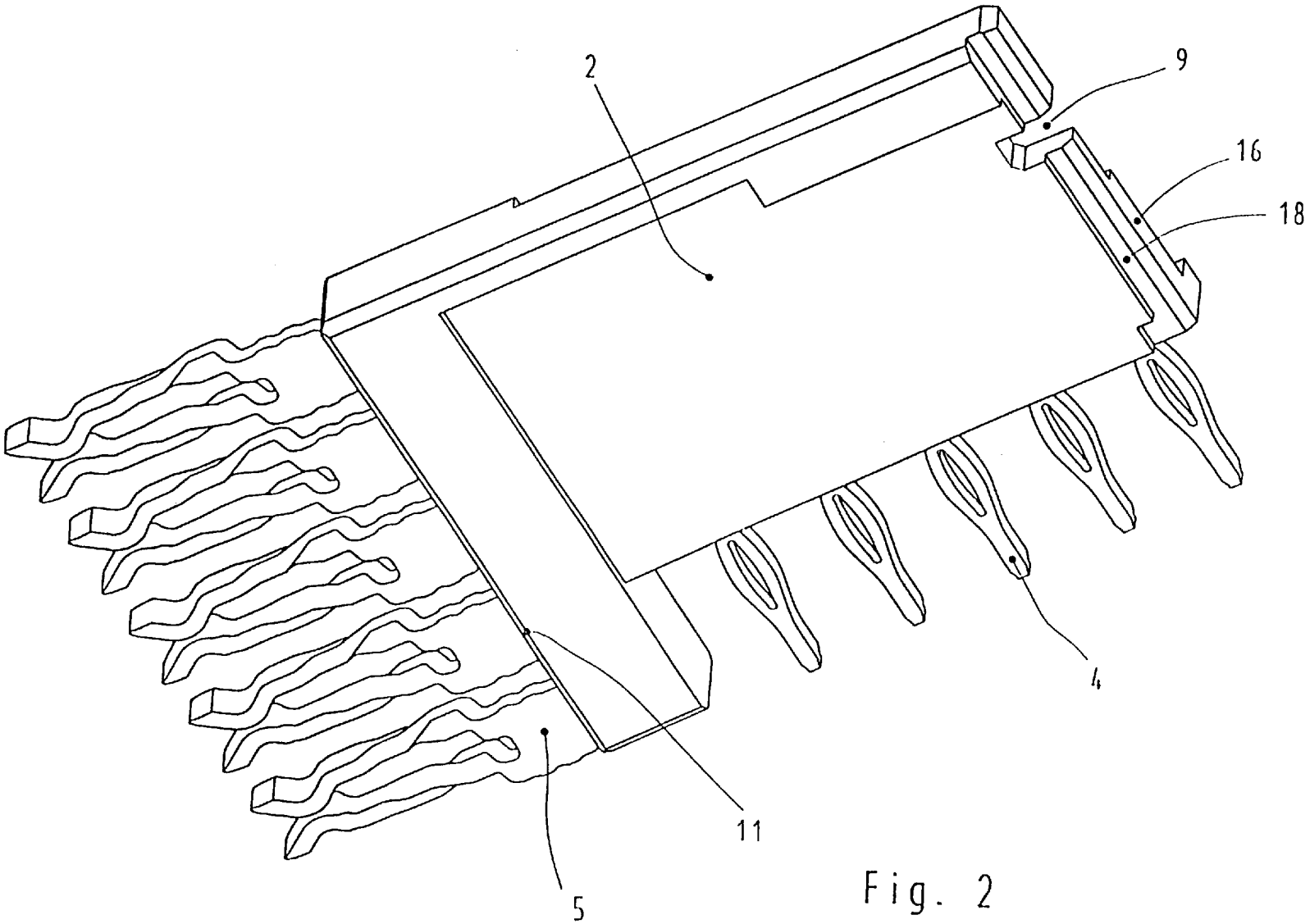
FIG. 2 is a perspective view of a segment used in the plug connector shown in FIG. 1.

FIG. 2 illustrates an individual segment 2 of the plug connector 1 according to FIG. 1. The segment 2 consists of insulating material into which the terminals 4 to be connected to a circuit board (not shown) are embedded. The terminals 4 extend at right angles to the contact springs 5. The segment has a first end surface 16, facing away from the contact springs 5, with a recess 18 and a second end surface 11 opposite this first end surface 16. A groove 9 extends in the first end surface 16 transversely to the longitudinal direction thereof.

The elongate additional member 3, shown in FIG. 3 and in detail in FIG. 3*a*, of the plug connector 1 according to FIG. 1 has a comb-like structurewherein some of the comb-like projections 24 extending from a bearing surface 15 comprise laterally sprung detents 12. On the longitudinal side of each comb-like projection 24 a protuberance 25 is in each case provided on the bearing surface 15. Projections 7 and pin-like projections 27 are provided at the ends of the comb-like projections 24 remote from the bearing surface 15. At the longitudinal ends of the additional member 3 the bearing surface in each case comprises a protrusion 17 and a rib-like projection 8.

FIG. 4 shows an enlarged portion of the carrier member 19 of the plug connector 1 according to FIG. 1. The strip contains recesses 20 in each case delimited by a stop 10. A lateral support wall 21 is provided, upon which ribs 23 with cut-outs 26 are integrally formed. The support wall 21 also comprises a plurality of locating openings 14.

In accordance with FIG. 1, the additional member 3 consisting of insulating material is inserted from below into the carrier body 19, into which the segments have likewise previously been inserted from below with their contact springs 5 facing upwards. The sprung detents 12 of the additional member 3 now snap into the corresponding locating openings 14 in the support wall 21 of the carrier body 19. On the one hand the segments 2, and on the other hand the comb-like projections 24 of the additional member 3 are supported between the ribs 23. This provides for the secure locking of the segments 2. When the plug connector 1 is in the ready assembled state, the projections 7 of the additional member 3 hold the contact springs 5 of the segments 2 firmly in position. The offset contact springs 5 of the segments 2 now engage with the projections 7, thus ensuring reliable contacting with contact blades of a complementary plug connector (not shown) in the carrier body 19. With its bearing surface 15, the additional member 3 presses against the first end surface 16 of each segment 2 and thus presses the second end surface 11 of each segment 2 against the associated stop 10 of the carrier body 19. In this way the insertion depth of the segments 2 into the carrier body 19 is precisely defined.

Via the rib-like projections 8, which in each case engage into the groove 9 of a segment 2, the segments are retained transversely relative to the plug-in direction by means of the additional member 3. The outermost segments of the sprung plug connector are in each case secured by the protrusion 17 in the edge region of the additional member 3, which protrusion 17 enters the recess 18 of the corresponding segment 2. Secure locking of the additional member 3 is achieved by means of the integral protuberances 25 which engage in the cut-outs 26 of the ribs 23 of the support wall 21 of the carrier body 19. The pin-like projections 27 of the additional member 3 are also provided for the same purpose, said projections 27 extending, together with the contact springs 5 of the segments 2, into the recesses 20 of the carrier body 19.

The described plug connector 1 is designed such that upon the removal of the additional member 3, the segments 2 are no longer retained in the carrier body 19. This permits rapid and simple disassembly. Alternatively however, for a simplified assembly of the plug connector 1, means can be provided for holding together the segments 2 and carrier body 19 so that these are held together without the additional member 3 and thus form a unit which can be pre-assembled.

What is claimed is:

1. An electric plug connector including a carrier body (19) formed of an insulating material, said carrier body having spaced recesses (20), a support wall 21, with spaced ribs 23 thereon, a plurality of segments (2), each having contacts (5) and terminals (4), said segments (2) being positioned in said carrier recesses (20), an additional member (3) of an insulating material for locking said segments within said carrier body (19), said additional member (3) having a plurality of uniformly spaced projections (24), which projections extend within said carrier recesses (20) adjacent the segments (2) and are supported between ribs 23 and adjacent said segments (2).

2. A plug connector according to claim 1, characterized in that the terminals (4) of the segments (2) are connectible at right angles to the direction of insertion of the contacts (5) into the carrier recesses (19).

3. A plug connector according to claim 1, characterized in that the contacts (5) of the segments (2) are offset and engage with the projections (7) of the additional member (3).

4. A plug connector according to claim 3, characterized in that the carrier body (19) comprises a stop (10), that the segments (2) are formed with a first end surface (16) facing away from the contacts (5) and with a second end surface (11) opposite said first end surface (16), and that the additional member (3) comprises a bearing surface (15) which presses against the first end surface (16) of a segment (2) and thus presses the second end surface (11) of the segment (2) against the stop (10) of the carrier body (19).

5. A plug connector according to claim 4, characterized in that the additional member (3) has retaining projections (8) which in each case engage into a corresponding opening (9) of a first end surface (16), facing away from the contacts (5), of a segment (2) in order to retain the segment (2) transversely to the direction of insertion of the contacts (5) into the carrier recesses (19).

6. A plug connector according to claim 4, characterized in that the bearing surface (15) of the additional member (3) has a protrusion (17) which engages into a corresponding recess (18) of the upper end surface (16) of an outer segment in order to fix said segment in the carrier body (19).

7. A plug connector according to claim 1, characterized in that the additional member (3) comprises sprung detents (12) which in each case engage into a locating opening (14) of the carrier body (19) for the firm locking of the additional member (3) to the carrier body (19).

8. A plug connector according to claim 1, characterized in that the carrier body (19) comprises a support wall (21) with ribs (23), said ribs having cut-outs (26) into which corresponding, integral protuberances (25) of the additional member (3) engage.

9. A plug connector according to claim 1, characterized in that the carrier body (19) and the segments (2) are held together only by means of the additional member (3).

* * * * *